US011289295B2

(12) United States Patent
Ängquist et al.

(10) Patent No.: US 11,289,295 B2
(45) Date of Patent: Mar. 29, 2022

(54) CIRCUIT BREAKER

(71) Applicant: SCIBREAK AB, Enköping (SE)

(72) Inventors: Lennart Ängquist, Enköping (SE); Staffan Norrga, Stockholm (SE); Antoine Baudoin, Stockholm (SE)

(73) Assignee: SCIBREAK AB, Enköping (SE)

( * ) Notice: Subject to any disclaimer, the term of this patent is extended or adjusted under 35 U.S.C. 154(b) by 121 days.

(21) Appl. No.: 16/633,031

(22) PCT Filed: Jul. 13, 2018

(86) PCT No.: PCT/SE2018/050767
§ 371 (c)(1),
(2) Date: Jan. 22, 2020

(87) PCT Pub. No.: WO2019/022659
PCT Pub. Date: Jan. 31, 2019

(65) Prior Publication Data

US 2020/0251295 A1 Aug. 6, 2020

(30) Foreign Application Priority Data

Jul. 24, 2017 (SE) ..... 1750958-9

(51) Int. Cl.
*H01H 3/00* (2006.01)
*H01H 50/56* (2006.01)
(Continued)

(52) U.S. Cl.
CPC ..... *H01H 50/56* (2013.01); *H01H 50/18* (2013.01); *H01H 50/44* (2013.01); *H01H 2235/01* (2013.01)

(58) Field of Classification Search
CPC ..... H01H 50/56; H01H 50/18; H01H 50/44; H01H 2235/01; H01H 33/6662; H01H 3/60
(Continued)

(56) References Cited

U.S. PATENT DOCUMENTS 5,241,290 A * 8/1993 Sehmer ..... H01H 71/56 335/132
6,657,150 B1 * 12/2003 Shea ..... H01H 3/3031 218/154
(Continued)

FOREIGN PATENT DOCUMENTS

| | | |
|---|---|---|
| EP | 2075817 | 7/2009 |
| EP | 3018685 | 5/2016 |
| GB | 1157015 | 7/1969 |

OTHER PUBLICATIONS

Roodenburg et al., "Design of a fast linear drive for (hybrid) circuit breakers—Development and validation of a multi domain simulation environment", Mechatronics, 2008, vol. 18, 159-171.
(Continued)

*Primary Examiner* — Shawki S Ismail
*Assistant Examiner* — Lisa N Homza
(74) *Attorney, Agent, or Firm* — Duane Morris LLP; Gregory M. Lefkowitz

(57) ABSTRACT

A circuit breaker comprises a switch and an actuator comprising a displaceable shaft mechanically connected to a movable contact in the switch. A Thomson coil is adapted to displace the shaft in a first direction, and a disconnecting device is connected in series with the switch and that is adapted to open during an interval when current is extinguished. An energy storage is provided being a separate part from the shaft and being adapted to store energy when the shaft moves in the first direction and to release energy to displace the shaft in a second direction, comprising a mass-spring arrangement with a body, a first spring between the shaft and one end portion of the body at a side facing the shaft and a second spring at a first end portion connected to a side of the body facing from the shaft and at second end portion being fixed. The movement of the body continues undisturbed to achieve a time interval wherein a current is extinguished. A current-interrupting arrangement for a circuit breaker is provided that has a simple mechanical construction and which can handle the problem at closing-in into a permanent fault in an adequate way.

7 Claims, 10 Drawing Sheets

(51) Int. Cl.
*H01H 50/18* (2006.01)
*H01H 50/44* (2006.01)

(58) Field of Classification Search
USPC ..... 335/185
See application file for complete search history.

(56) References Cited

U.S. PATENT DOCUMENTS 6,794,777 B1* 9/2004 Fradella ..... F16C 32/0457 310/68 B
7,528,332 B1* 5/2009 Via ..... F01L 25/04 200/82 B
10,923,298 B1* 2/2021 Chen ..... H01H 3/46
2009/0127864 A1* 5/2009 Alvite ..... F03B 17/04 290/1 C
2015/0206683 A1 7/2015 Kanaya et al.
2015/0235784 A1* 8/2015 Karlstrom ..... H01H 1/50 200/48 R
2015/0332880 A1* 11/2015 Falkingham ..... H01H 33/666 218/142
2017/0084412 A1* 3/2017 Bujotzek ..... H01H 1/385
2017/0178844 A1 6/2017 Norrga et al.
2017/0358411 A1* 12/2017 Woo ..... H01H 33/666
2019/0013662 A1 1/2019 Norrga et al.
2020/0168421 A1* 5/2020 Dye ..... H01H 50/002
2020/0243286 A1* 7/2020 Leccia ..... H01H 33/664
2020/0258704 A1* 8/2020 Yu ..... H01H 33/285
2020/0411262 A1* 12/2020 Zhou ..... H01H 33/6662
2021/0098218 A1* 4/2021 Elmiger ..... H01H 50/18

OTHER PUBLICATIONS

Peng et al., "A Fast Mechanical Switch for Medium-Voltage Hybrid DC and AC Circuit Breakers", IEEE Transactions on Industry Applications, 2016, vol. 52, No. 4, 2911-2918.

* cited by examiner

CIRCUIT BREAKER

CROSS-REFERENCE TO RELATED APPLICATIONS

This application is a § 371 national stage entry of International Application No. PCT/SE2018/050767, filed Jul. 13, 2018, which claims priority of Sweden National Application No. 1750958-9 filed Jul. 24, 2017, the entire contents of which are incorporated herein by reference.

TECHNICAL FIELD

The present invention relates to a circuit breaker which incorporates a fast-acting mechanical current-interrupting switch and a series-connected disconnecting device.

BACKGROUND ART

Fast-acting mechanical circuit-breakers, which operate independent of natural zero-crossings in the load current are required in power systems based on direct current, e.g. High Voltage Direct Current (HVDC) systems. They also find applications as current-limiting circuit-breakers in AC systems.

The inductance in the connected network keeps magnetic energy at the instant, when the non-zero current becomes extinguished, and therefore an energy-absorbing device is connected in at least one branch in parallel with the interrupting switch. Typically, a Metal Oxide Varistor (MOV), which also provides a sharp voltage limitation of the voltage across the interrupter terminals, is used for this purpose.

Arrangement of a fast-acting mechanical current interrupter and a series-connected disconnecting device can be used to implement a circuit-breaker that fulfills the demands described above. In patent applications PCT/SE2015/050756 and Swedish Patent Application No 1551717-0 arrangements of this kind have been described. In these documents, auxiliary circuits that create artificial current zero-crossing(s) in the current through the mechanical current interrupter have been described. FIG. 1 shows an overview of such a circuit breaker which connects two electrical terminals 1 and 2 with a mechanical current-interrupting switch 10 having one or more parallel branches, and a disconnecting device 4 connected in series. The switch 10, which is typically a vacuum interrupter (VI), is equipped with a fast-acting actuator 5, which can separate the mechanical contacts in the current-interrupting switch 10 in very short time, typically not more than a few milliseconds. A mechanical actuator 6 controls the status of the disconnecting device 4.

The high speed of operation, within few milliseconds, of actuator 5 is of paramount importance for such breakers when used in e.g. high voltage direct current (HVDC) transmission systems, as very fast fault clearing is necessary to prevent total network collapse in meshed HVDC grid systems. Similarly, fast actuator action is required in current-limiting AC circuit breakers to execute current interruption of short-circuit current before its natural peak is reached.

Speed of operation of the disconnecting device actuator 6 may be slower than for the switch actuator 5.

The mechanical actuator 5 for the switch 10 thus must provide extreme force and acceleration of the driving shaft connected to the movable contact in switch 10. One example of known designs of the mechanical actuator is given in C. Peng/I. Husain/A. Huang/B. Lequesne/R. Briggs, "A Fast Mechanical Switch for Medium-Voltage Hybrid DC and AC Circuit Breakers", IEEE Transactions on Industry Applications, Vol. 52, No. 4, July/August 2016. FIGS. 2*a* and 2*b* show a vacuum interrupter 10 with an actuator utilizing repulsive Thomson coils. A vital function is to make the mechanical system bi-stable and for this purpose a special spring 15 of Belleville type is utilized.

Separate Thomson coils 12 and 13 are mounted on either side of an armature disk 14 to push a driving shaft 11 to position a movable contact 10*b* in the vacuum interrupter 10 in either of its stable open or closed positions. Each Thomson coil has its own storage of electrical energy and thyristor 16, 17. The state of the movable contact 10*b* in the vacuum interrupter is changed by excitation of one of the coils 12, 13 by triggering one of the thyristors 16, 17. The vacuum interrupter will be driven from its closed to its open state if thyristor 16 is triggered and discharges the charged capacitor through the coil 12. Similarly, it will change from its open to its closed state if thyristor 17 is triggered and discharges the charged capacitor through coil 13.

The severe requirements for both opening and closing operations make it difficult to design an actuator that satisfies all desired properties. Very strong force is applied to the armature disk 14 causing extreme acceleration and deceleration. At the same time, small tolerances in the position of the disk relative the Thomson coils 12 and 13 are necessary and this makes the mechanical design of the actuator used in FIG. 2 very complex and demanding. Furthermore, two separate sets 12, 16 and 13, 17 of electrical drive equipment, each one containing energy capacitor and a power electronic switch, are needed.

Another example of known designs of the mechanical actuator is published in B. Roodenburg/B. Evenblij, "Design of a fast drive for (hybrid) circuit breakers—Development and validation of a multi domain simulation environment", Mechatronics 18 (2008), pp. 129-171 (available online at www.sciencedirect.com). The principle is shown in FIGS. 3*a* and 3*b*. The proposed actuator has one single Thomson coil 12. It has a shaft 11, which is used to separate vacuum interrupter contacts 10*a* and 10*b*. The movable contact stroke is limited by a braking spring 18 having a latch mechanism 24, which locks the shaft, when a certain compression of the spring 18 has been obtained. The latching mechanism 24 is released to return the vacuum interrupter contact 10*b* to its closed state on the command to close the current-interrupting switch 10.

Very high force must be applied to the driving shaft 11 to reach sufficient gap between the contacts in the vacuum interrupter in desired time at opening the current interrupting switch 10. The Thomson coil 12 accelerates the armature disc 14 connected to the shaft 11 to its initial velocity in very short time (portion of a millisecond) and the spring 18 needs to be very stiff to decelerate the shaft 11 so it can be stopped before maximum allowed stroke has been exceeded. This fact implies that the latching mechanism 24 must be very fast and able to handle very high spring force. The high force calls for an advanced design of the latching mechanism as described in the paper [2].

In practical application of a circuit-breaker of the actual kind it is normally required that the breaker, beside its capability to interrupt current, shall also have a voltage withstand capability according to standards (BIL level) in open state. This requirement can be satisfied by the disconnecting device 4 connected in series. The latter operates with zero or almost zero current and provides a physical separation of the breaker terminals 1 and 2.

Although fast interruption is the predominant requirement it is also necessary that the breaker can perform safe closing operations. Particularly the close-in into a permanently short-circuit is very demanding as large electro-mechanical forces oppose closing of the contacts, which may e.g. cause contact bouncing that may result in contact welding.

SUMMARY OF INVENTION

An object of the present invention is to overcome the problems and shortcomings of the prior art and to provide a circuit breaker with a superior current-interrupting arrangement that has a simple mechanical construction and which can handle the problem at closing-in into a permanent fault in an adequate way. The principle of the invention is illustrated in FIGS. 4*a* and 4*b*.

According to the invention, a circuit breaker is provided comprising a switch with a fixed contact and a movable contact, an actuator comprising a shaft mechanically connected to the movable contact in the switch, the shaft being displaceable in a first direction, wherein the movable contact moves from the fixed contact, and a second direction, wherein the movable contact moves towards the fixed contact, a Thomson coil adapted to displace the shaft in the first direction, and a disconnecting device connected in series with the switch and that is adapted to open during an interval when current is extinguished, which is characterized by an energy storage being a separate part from the shaft and being adapted to store energy when the shaft moves in the first direction and to release energy to displace the shaft in the second direction, wherein the energy storage comprises a mass-spring arrangement with a body having a mass, a first spring placed between the shaft and one end portion of the body at a side facing the shaft and a second spring at a first end portion connected to a side of the body facing from the shaft and at second end portion being fixed, and wherein the movement of the body continues undisturbed to achieve a time interval wherein a current is extinguished.

In a preferred embodiment, the mass of the body and parts connected thereto is essentially the same as the mass of the movable contact, the shaft, and parts connected thereto.

In a preferred embodiment, the first spring has a stiffness significantly higher than the stiffness of the second spring.

In a preferred embodiment, at least one of the first and second springs is a solid mechanical spring.

In a preferred embodiment, at least one of the first and second springs comprises a pneumatic or hydraulic piston.

In a preferred embodiment, at least one of the springs provides damping to the return movement of the body.

In a preferred embodiment, the energy storage comprises a rotational inertia.

BRIEF DESCRIPTION OF DRAWINGS

The invention is now described, by way of example, with reference to the accompanying drawings, in which.

DETAILED DESCRIPTION OF EMBODIMENTS

Figure 8:
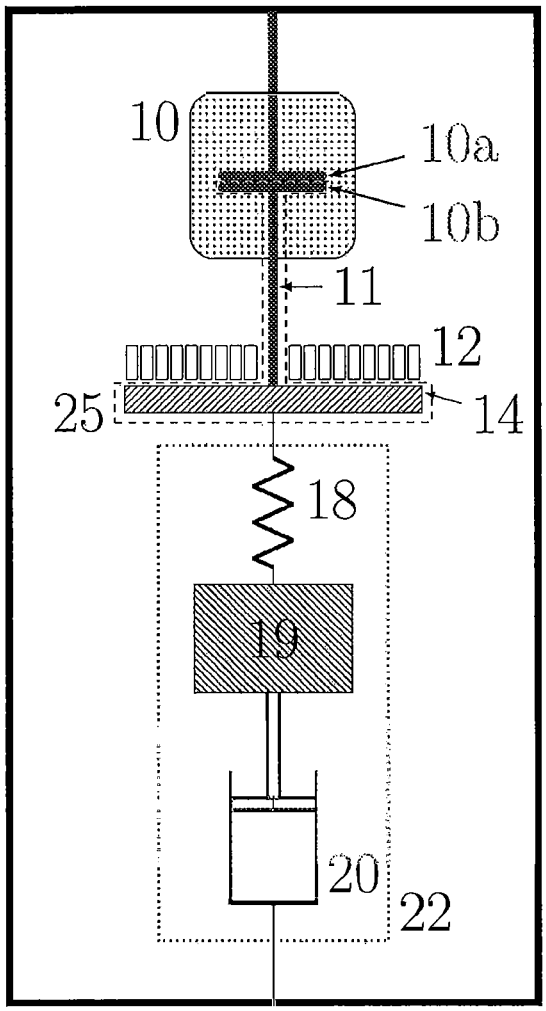
FIG. 8 shows an embodiment of a spring as a pneumatic piston compressing gas in a cylinder.

In the following, a detailed description of a circuit breaker comprising with a current-interrupting arrangement according to the invention will be given. Throughout this description, when the term "spring" is used, it is to be construed as any kind of means having a spring effect, unless stated otherwise. The spring effect is characterised by that the device produces a force, which is increasing with its compression. Such a device can be solid mechanical spring or a pneumatic spring as shown in FIG. 8. When the term "Thomson coil" is used herein, it should be construed as an electro-magnetic force-generating device or arrangement including both a flat coil and an armature disc, unless otherwise stated. However, this expression also encompasses dual armature windings with a first winding, corresponding to the flat coil, and a second winding, corresponding to the armature disc.

Figure 1:
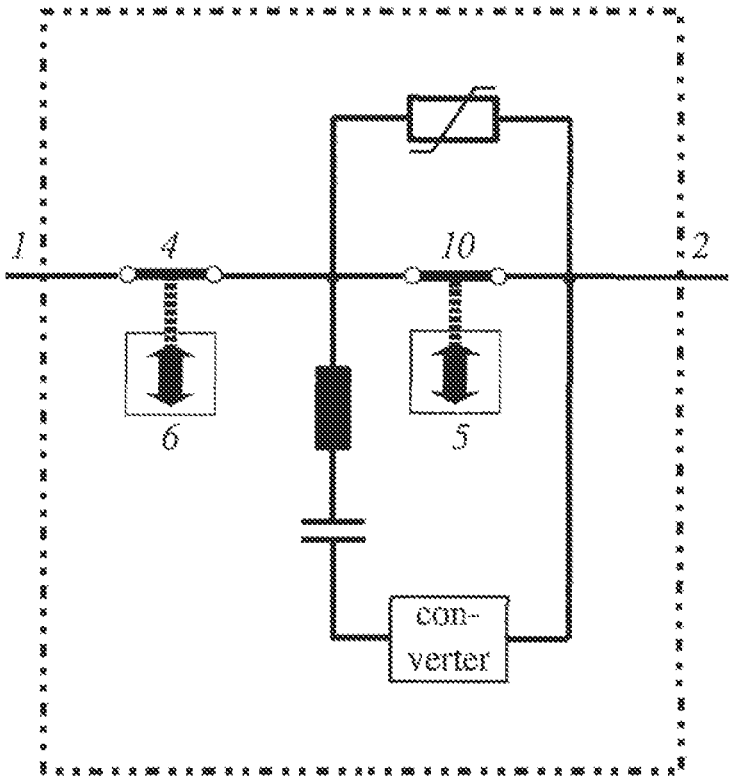
Fig. 1 PRIOR ART
FIG. 1 shows an overview of a circuit breaker with a current-interrupting arrangement and a series-connected disconnecting device.
Figure 4A:
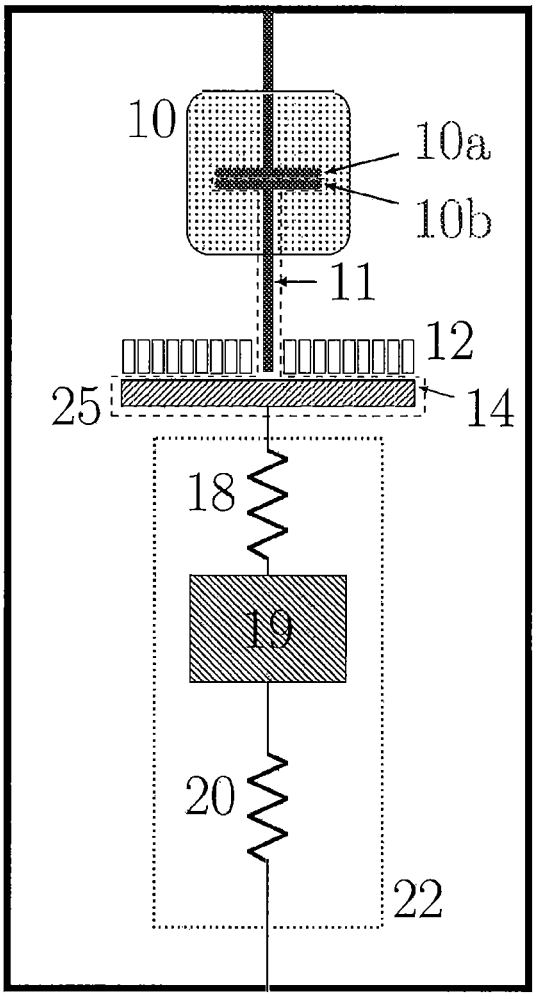
FIGS. 4*a* and 4*b* show first embodiment of a current-interrupting arrangement for a circuit breaker according to the invention in an open and a closed state, respectively, and comprising an energy storage being a separate part from the driving shaft containing a body with a mass-spring arrangement.
Figure 4B:
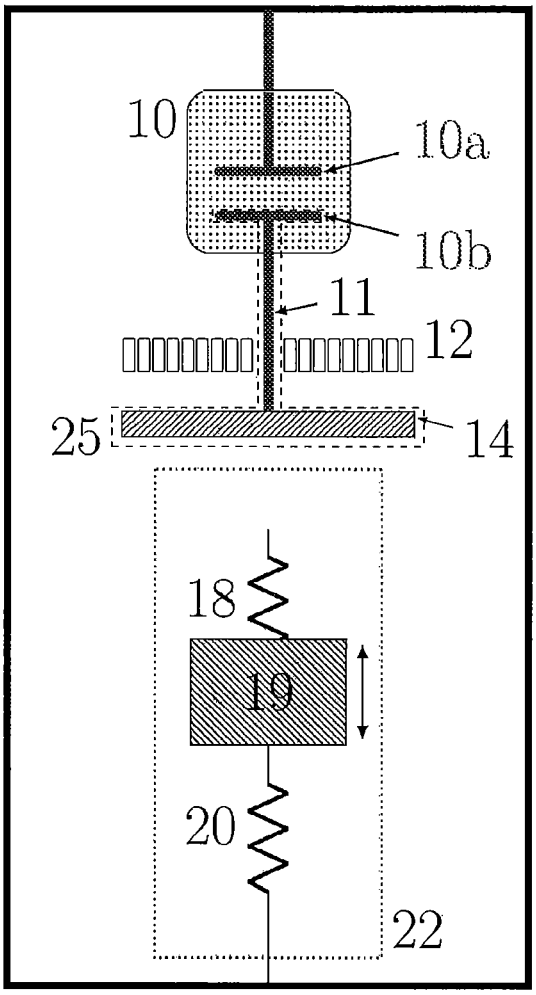
Figure 5:
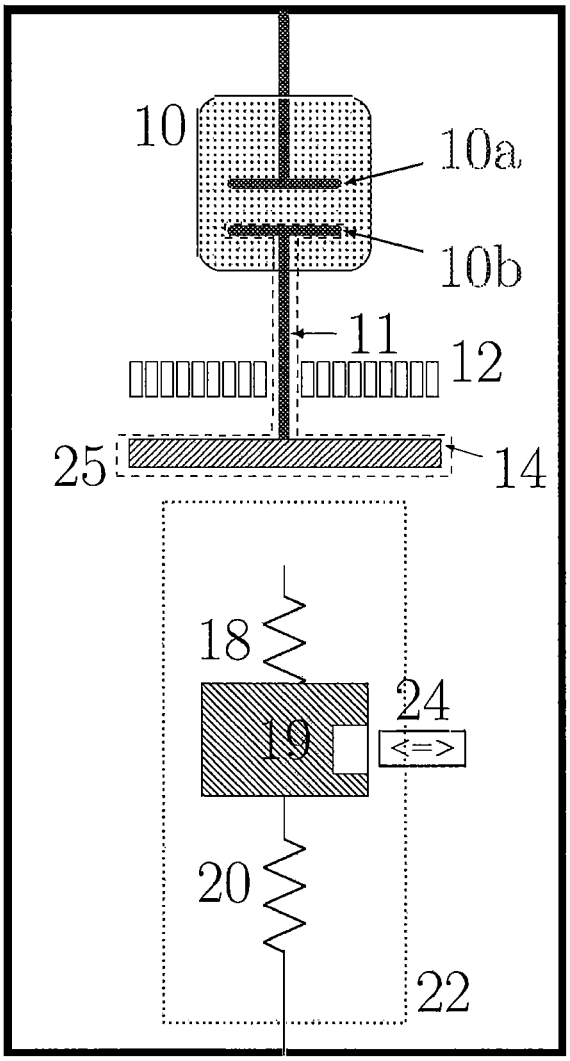
FIG. 5 shows a second embodiment of a current-interrupting arrangement for a circuit breaker according to the invention comprising an energy storage being a separate part from the driving shaft containing a body with a mass-spring arrangement also using a mechanical latch.

A current-interrupting arrangement according to the invention is presented in FIGS. 4*a* and 4*b*. One single Thomson coil 12 acts on a metal armature disc 14 connected with a driving shaft 11 that is linked to a movable contact 10*b* in the current-interrupting switch 10. The whole arrangement that is fixed to the shaft 11, i.e. the shaft 11, the movable contact 10*b*, the armature disc 14 and possibly other devices like dampers 15 (FIG. 1) etc., will be denoted here as the "shaft assembly" 25. The total mass of the shaft assembly 25 is M1. There is also a fixed contact 10*a*.

The shaft 11 also is interacting with an energy storing arrangement 22 consisting of a separate body 19 with mass (including other components fixed connected to the body), M2, and a spring arrangement. The spring arrangement comprises a first spring 18 that is clamped between the shaft assembly 25 and the body 19. The connection is not fixed, but the first spring 18 is free to separate from at least one of the shaft 11 and the body 19 in the energy storage 22 whenever it is decompressed and has regained its unloaded length. A second spring 20 is placed between the body 19 and a fixed structure. The mass of the body, M2, approximately matches the total weight, M1, of the shaft assembly. Typically, the first spring stiffness, K1, is much higher than that of the second spring, K2.

In a first preferred embodiment the current-interrupting switch 10 is arranged to temporarily extinguish the current passing through it during a limited time interval. The body 19 and the springs 18 and 20 are assembled and clamped in the current-interrupting switch 10 in a such a way that a closing force is always exerted on the movable contact 10*b* whenever the current-interrupting switch 10 is at rest. Then the armature disc 14, connected with the shaft 11, is located close to the flat Thomson coil 12. The closing force, pressing the contacts 10*a* and 10*b* together, mainly is determined by the stiffness K2 of the second spring and the initial compression of the energy storage 22. FIG. 4*a* illustrates the conditions when the switch 10 is resting in closed position.

Figures 2A, 2B:
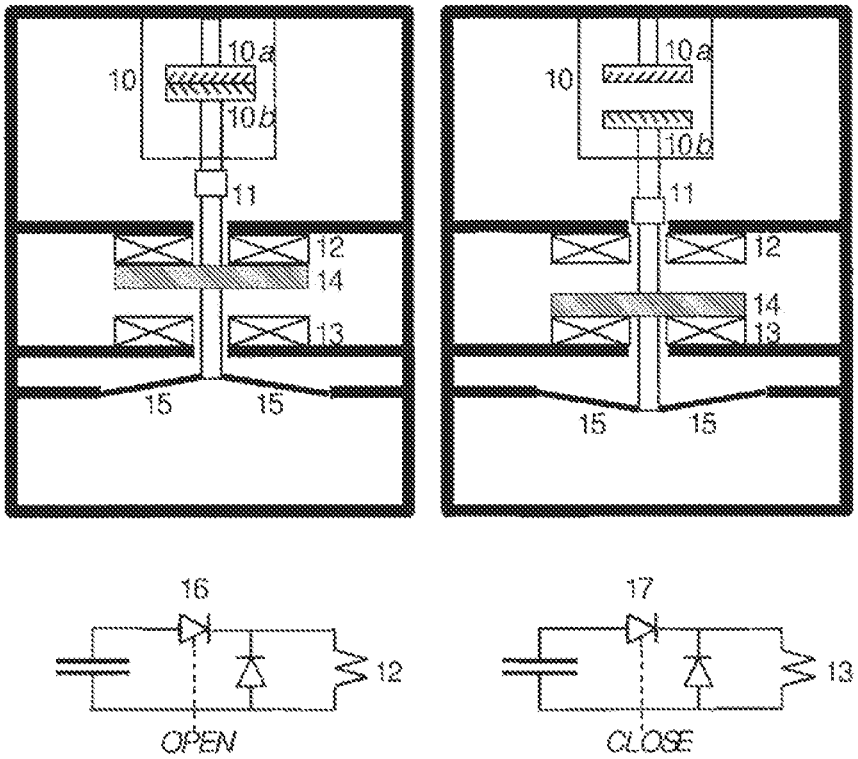
Fig. 2a PRIOR ART
Fig. 2b PRIOR ART
FIGS. 2*a* and 2*b* show prior art current-interrupting arrangement described in paper reference [1] in open and closed state, respectively.
Figure 3A:
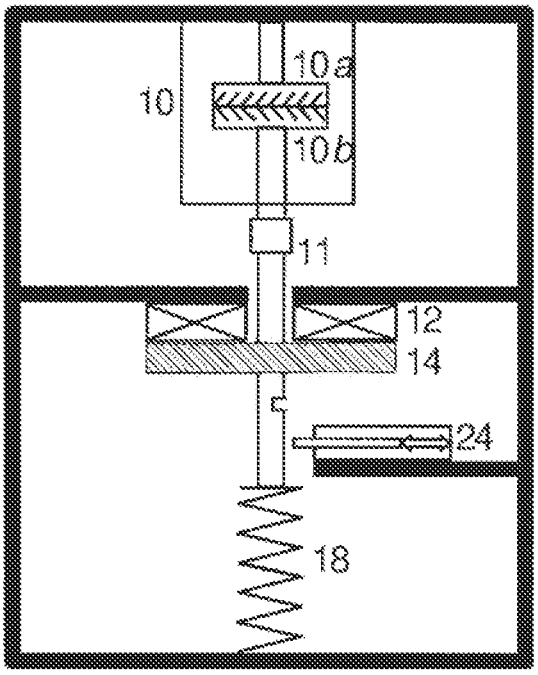
Fig. 3a PRIOR ART
FIGS. 3*a* and 3*b* show prior art current-interrupting arrangement described in paper reference [2] in open and closed state, respectively.
Figure 3B:
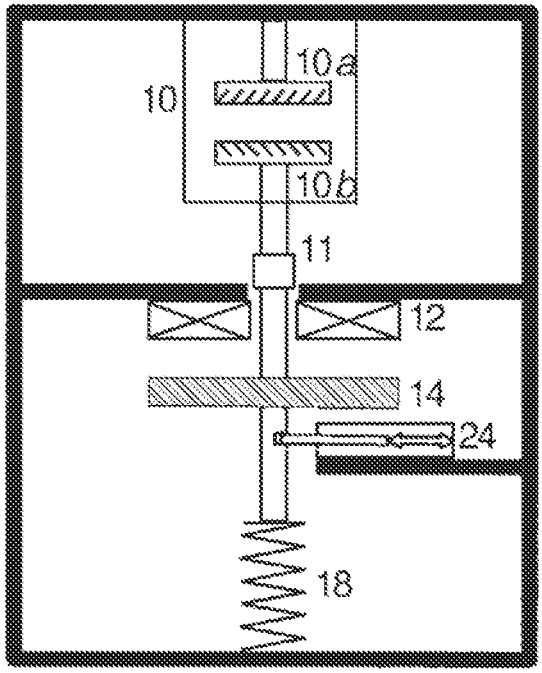
Fig. 3b PRIOR ART

At an opening operation, the thyristor 16 (FIG. 2*a*) that excites the Thomson coil 12 becomes triggered and a very strong repulsing force, such as several tens of kN, is applied on the disk 14 in the direction that separates the fixed contact 10*a* and the movable contact 10*b* in the current-interrupting switch 10. The acceleration force surpasses the gravitational force and friction force by orders of magnitude making the impact of gravitation negligible. The duration of the force pulse is quite short (less than one millisecond) giving the shaft assembly 25 a high initial velocity, V0, necessary to achieve a sufficient contact gap, required for the necessary voltage withstand capability, in a very short time.

Figure 6:
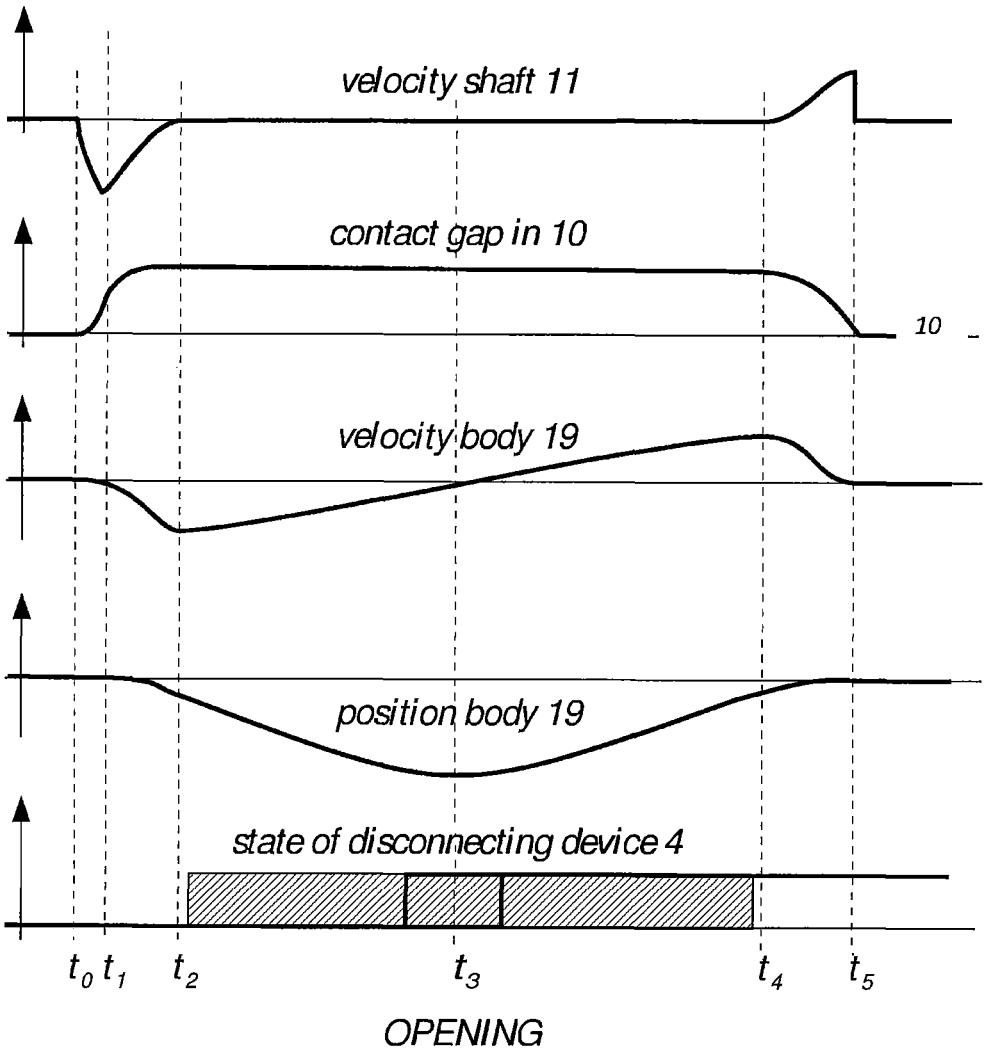
FIG. 6 presents time-line diagrams for the operation of the current-interrupting arrangement for a circuit breaker according to the invention.

FIG. 6 shows time diagrams for various quantities related to the opening operation of the current-interrupting switch 10. The Thomson coil 12 is activated at time t0 and the shaft 11 gets its initial speed V0 almost immediately at time t1.

The high velocity of the shaft 11 makes it necessary to apply a very strong decelerating force to stop it in a short distance, not to exceed the maximum mechanical stroke of the mechanical switch in the current-interrupting switch 10. The desired deceleration is achieved by compressing the stiff first spring 18 between the shaft 11 and the body 19 in the energy storage 22. The deceleration from spring 18 may be active already from the t0, as indicated in FIG. 6. The deceleration of the shaft assembly 25 lasts from t0 to t2. The shaft assembly 25 reaches standstill at the end of this interval, at t2.

The compression of the first spring 18, causing deceleration of the shaft assembly 25, simultaneously accelerates the body 19 in the energy storage 22. Ideally, assuming equal masses M1=M2 and considering only the first spring 18, the shaft assembly 25 is brought to stand-still while the body 19 in the energy storage at time t2 achieves the initial velocity V0 of the shaft assembly 25. Using this approximation, the condition is reached after time Tdecr given by $$Tdecr = t2 - t1 = \frac{\pi}{\sqrt{2}}\sqrt{\frac{M1}{K1}}$$

Thus, at time t2 the first spring 18 regains its unloaded length, the shaft assembly 25 is almost still-standing and the body 19 in the energy storage 22 moves away with the shaft assembly's initial velocity V0. At this time, the clamping of the first spring between the shaft 11 and the body 19 disappears and the first spring 18 becomes free to separate from either of the shaft 11 and the body 19. The body 19 and the second spring 20 now establish a linear harmonic oscillator and the movement of the body is described by a sinusoidal function of time. This is shown in FIG. 6 as the time interval between t2 and t4. The oscillation frequency is determined by the mass, M2, of the body 19, and the stiffness, K2, of the second spring 20, and it can be freely selected. The half-cycle time of the oscillation is given by $$Tdelay = \pi\sqrt{\frac{M2}{K2}}$$

After the half-cycle delay, at time t4 in FIG. 6, the body 19 reaches the position where the first spring 18 again hits the still-standing shaft assembly 25 and becomes compressed. The inverse process, now with deceleration of the body 19 in the energy storage and acceleration of the shaft 11, then occurs, causing the movable contact 10*b* in the current-interrupting switch 10 to travel in the direction to close the contacts 10*a* and 10*b* in the switch 10. This process is shown in FIG. 6 during the time interval t4 to t5. At the end of this time interval the contacts are closed again.

Accordingly, in this process the fast-acting current-interrupting switch 10 first opens the contacts 10*a* and 10*b* and after a half-cycle delay, Tdelay, recloses them again. During this interval, t2 to t4 in FIG. 6, the current through the current-interrupting switch 10 is extinguished. A disconnecting device 4 (FIG. 1), connected in series with the current-interrupting switch 10, can be opened, during the interval with extinguished current, t2 to t4, gaining full voltage withstand capability before the movable contact 10*b* in the switch 10 is brought back into its closed state.

The arrangement and method described above automatically provide the desired deceleration of the movable contact 10*b* and safely limit the stroke of the shaft assembly 25. Furthermore, a zero-current interval is created that allows the disconnecting device 4 to operate.

Immediately after the opening procedure described in the above, the circuit-breaker is ready to perform a closing operation, which is executed by the disconnecting device 4 operated by actuator 6. If this operation ends in a close-in into a short-circuit the current-interrupting switch 10 is ready to act immediately.

In a second preferred embodiment of the invention a latching mechanism 24 is provided to catch and lock the body 19 in the energy storage 22 at its turning point t3, see FIG. 6, in the time interval t2 to t4, i.e. when the second spring 20 is at or close to the point with maximum compression. As the stiffness, K2, of the second spring 20 is significantly lower than the stiffness, K1, of the first spring 18, the compression length of the second spring 20 is much longer than the compression of the first spring 18. The force in the second spring 20 therefore is much weaker than the force in the first spring 18 and it is much easier to arrange a simple latching mechanism. The closing operation in this case can be executed at any delay by command to the latching mechanism. The lower force acting on body 19 makes it possible to avoid complex design of the latching mechanism like those described in reference [2].

Figure 7A:
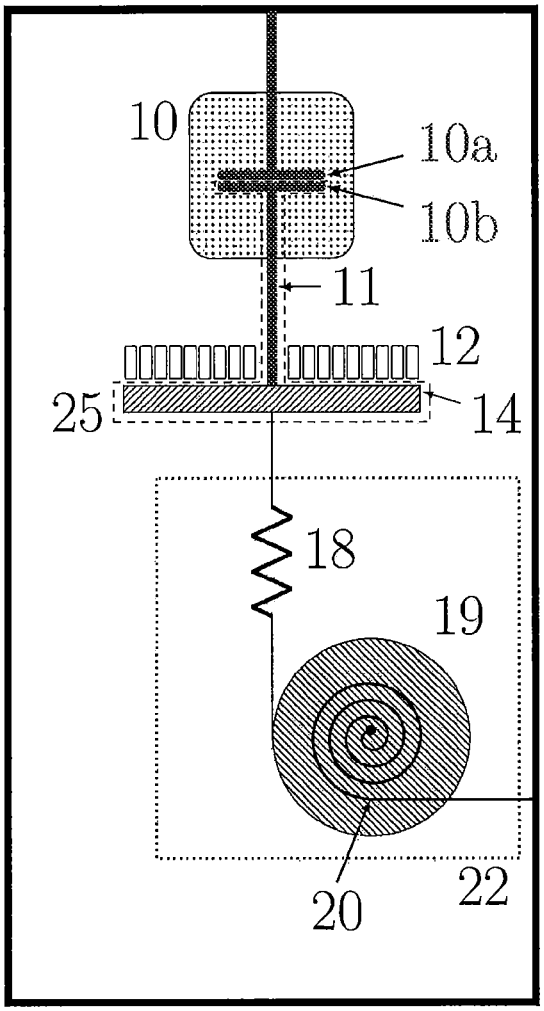
FIGS. 7*a* and 7*b* show a current-interrupting arrangement for a circuit breaker according to the invention wherein the energy storage is implemented with a rotational movement of an inertia.
Figure 7B:
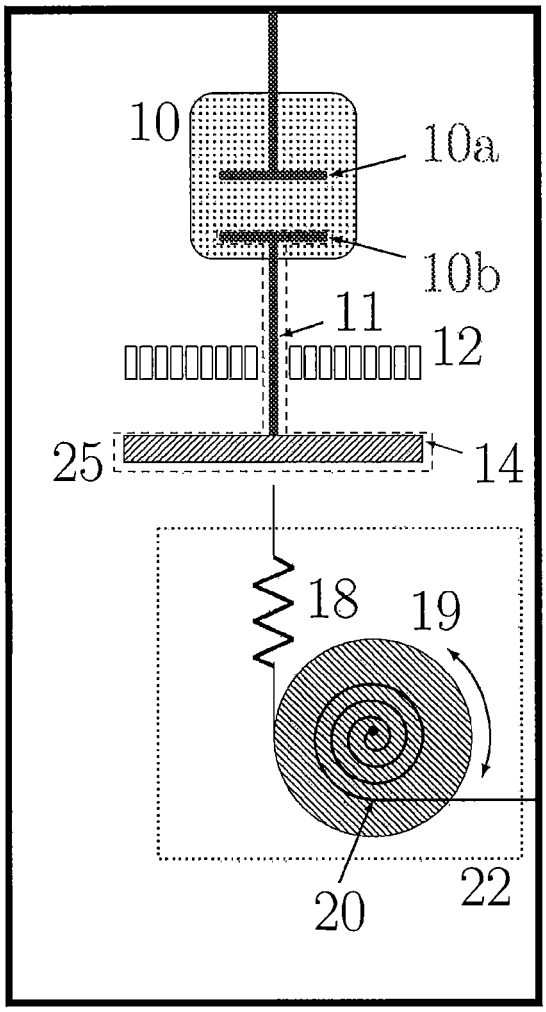

In a third embodiment of the invention the kinetic energy storage 22 is arranged as a rotational movement of an inertia as shown in FIG. 7. Similar considerations as in the preceding embodiment apply in this case.

In a fourth embodiment a pneumatic piston in a cylinder, as in FIG. 8, is provided to act as the second spring 20 in the energy storage 22. The spring force is obtained when the gas in the cylinder is compressed by the piston.

Figure 9A:
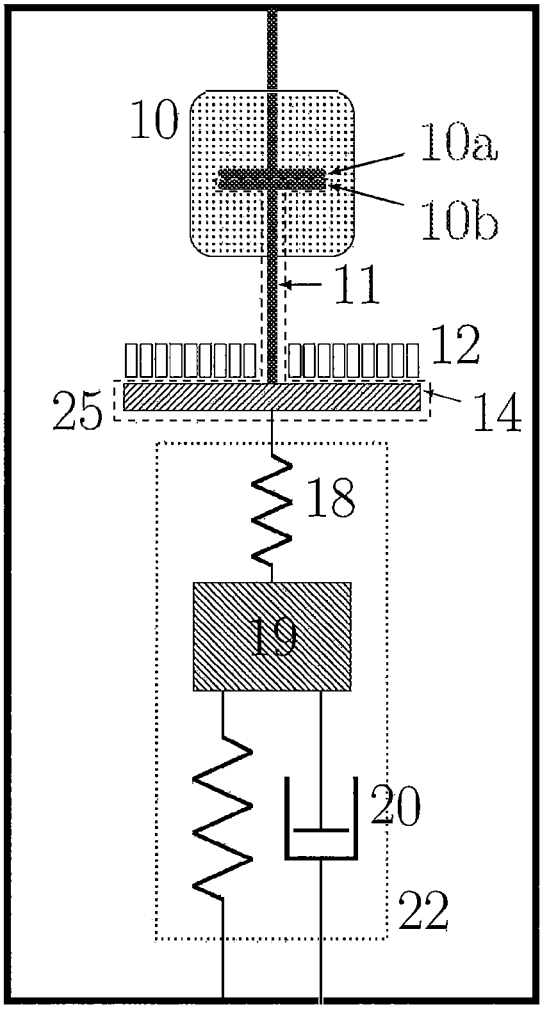
FIGS. 9*a* and 9*b* show different methods to implement viscous damping of the spring arrangements in the energy storage.
Figure 9B:
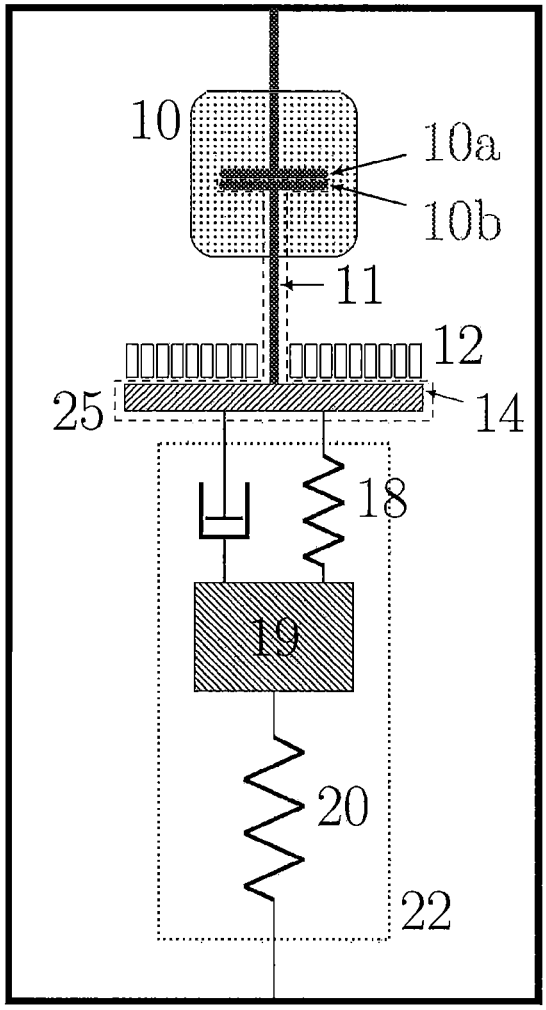

It might be desired to utilize a closing velocity, that is lower than the force provided by the Thomson coil at opening, to avoid damage of the contacts 10*a* and 10*b* in the switch 10. The force applied to the shaft assembly 11 in the closing action can be reduced by applying mechanical viscous damping in any one of the first or second springs 18 or 20 respectively, or by applying separate viscous damping devices in parallel with the springs. FIG. 9 show possible application of damping devices to reduce the force when the contacts in the switch 10 close.

Figure 10A:
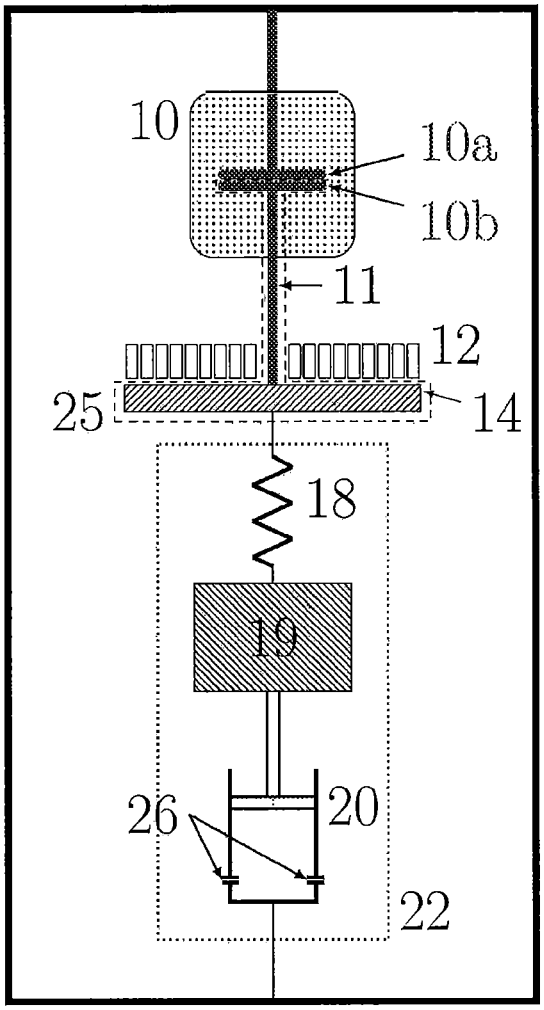
FIGS. 10*a* and 10*b* show a pneumatic spring with damping implemented as leakage openings in the cylinder wall, in open and closed state, respectively.
Figure 10B:
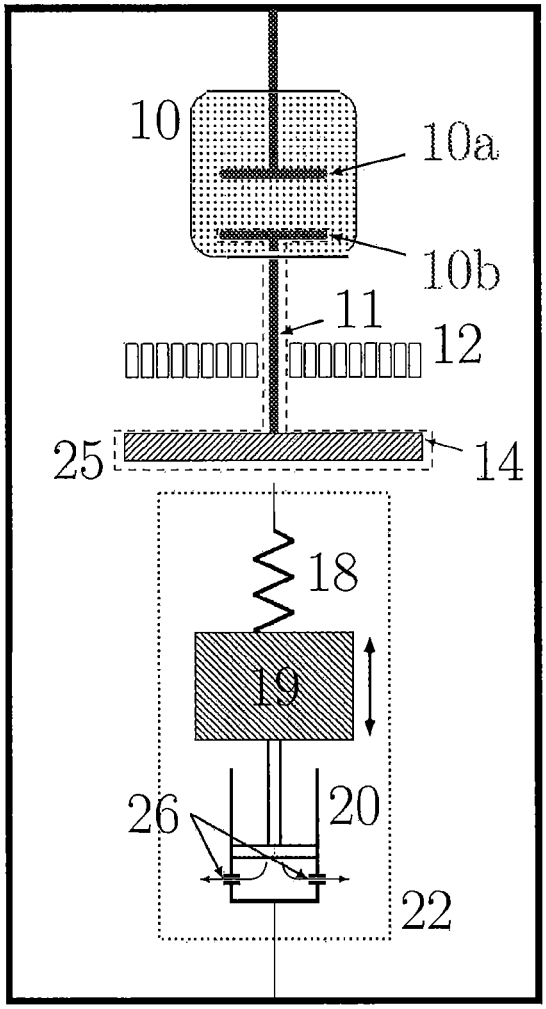

When pneumatic springs are used damping may be achieved by providing small holes so that some leakage occurs. The leakage causes an energy loss, which acts as a damping arrangement as shown in FIG. 10.

It is possible to design different implementations of the invention in many ways. E.g. can any separate bi-stable mechanism (like the Belleville disc in FIG. 2) be used to provide the closing force when the switch 10 is at rest. Then a small distance between the shaft assembly 25 and the energy storage 22 may exist when the switch 10 is in rest giving a higher initial acceleration of the shaft assembly 11 when an opening operation is initiated.

The contact arrangement has been described as comprising a first, fixed contact and a second, movable contact. It will be appreciated that also the first contact may be movable without affecting the basic function of the actuator.

The invention claimed is:

1. A circuit breaker comprising:

a switch with a fixed contact and a movable contact, and an actuator comprising a shaft mechanically connected to the movable contact in the switch, the shaft being displaceable in a first direction, wherein the movable contact moves from the fixed contact, and a second direction, wherein the movable contact moves towards the fixed contact, a Thomson coil adapted to displace the shaft in the first direction, and a disconnecting device connected in series with the switch and that is adapted to open during an interval when current is extinguished, wherein an energy storage being a separate part from the shaft and being adapted to store energy when the shaft moves in the first direction and to release energy to displace the shaft in the second direction, wherein the energy storage comprises a mass-spring arrangement with a body having a mass, a first spring placed between the shaft and one end portion of the body at a side facing the shaft and a second spring at a first end portion connected to a side of the body facing from the shaft and at second end portion being fixed, and wherein the movement of the body continues undisturbed to achieve a time interval wherein a current is extinguished.

2. The circuit breaker according to claim 1, wherein the mass of the body and parts connected thereto is essentially the same as the mass of the movable contact, the shaft, and parts connected thereto.

3. The circuit breaker according to claim 1, wherein the first spring has a stiffness significantly higher than the stiffness of the second spring.

4. The circuit breaker according to claim 1, wherein at least one of the first and second springs is a solid mechanical spring.

5. The circuit breaker according to claim 1, wherein at least one of the first and second springs comprises a pneumatic or hydraulic piston.

6. The circuit breaker according to claim 1, wherein the at least one of the springs provides damping to the return movement of the body.

7. The circuit breaker according to claim 1, wherein the energy storage comprises a rotational inertia.

* * * * *